United States Patent [19]

Cacalloro et al.

[11] 4,209,064

[45] Jun. 24, 1980

[54] PANEL-TYPE RADIATOR FOR ELECTRICAL APPARATUS

[75] Inventors: Philip A. Cacalloro, Newton; Albert J. McCloy; Moreland P. Bennett, both of Hickory, all of N.C.

[73] Assignee: General Electric Company, Philadelphia, Pa.

[21] Appl. No.: 936,983

[22] Filed: Aug. 25, 1978

[51] Int. Cl.[2] ..... F28F 3/12

[52] U.S. Cl. ..... 165/130; 165/131; 165/170

[58] Field of Search ..... 165/106, 170, 175, 173, 165/178, 130, 131; 29/157.3 D, 157.3 V; 113/118 R, 118 D, 118 V; 228/183

[56] References Cited

U.S. PATENT DOCUMENTS

| | | | |
|---|---|---|---|
| 1,619,332 | 3/1927 | Dann | 165/106 |
| 1,726,458 | 8/1929 | Tellander | 165/170 |
| 2,285,225 | 6/1942 | Norris | 165/166 |
| 2,587,116 | 2/1952 | Clay | 165/170 |
| 2,596,642 | 5/1952 | Boestad | 165/166 |
| 3,153,447 | 10/1964 | Yoder et al. | 165/106 |
| 3,532,161 | 10/1970 | Lockel | 165/167 |
| 3,537,165 | 11/1970 | Paddock et al. | 113/118 D |
| 3,625,498 | 12/1971 | Adamel et al. | 165/168 |
| 4,099,559 | 7/1978 | Butt | 165/170 |

FOREIGN PATENT DOCUMENTS

| | | | |
|---|---|---|---|
| 55292 | 10/1938 | Denmark . | |
| 962430 | 6/1950 | France | 29/157.3 D |
| 1285347 | 12/1962 | France | 165/170 |
| 2403127 | 7/1975 | Fed. Rep. of Germany . | |

*Primary Examiner*—Sheldon Richter
*Attorney, Agent, or Firm*—William Freedman

[57] ABSTRACT

This panel-type radiator for extracting heat from liquid flowing therethrough comprises a panel through which the liquid flows in a downward direction. The panel is made from two dished metal sheets having aligned vertically-extending embossments welded together along a vertically-extending zone and providing spaced vertically-extending flow channels on opposite sides of the vertically extending zone. The portions of the sheets defining the walls of said channels are provided with vertically-spaced embossments arranged on each sheet in a generally herringbone pattern, with the individual embossments extending transversely of the vertically-extending zone via a path that slopes upwardly as the vertically-extending zone is approached.

7 Claims, 7 Drawing Figures

PANEL-TYPE RADIATOR FOR ELECTRICAL APPARATUS

BACKGROUND

This invention relates to a panel-type radiator for extracting heat from a liquid flowing therethrough and, more particularly, relates to a radiator of this type which is especially adapted for use with liquid-filled electrical apparatus, such as transformers and voltage regulators.

The usual panel-type radiator for this type of application comprises a plurality of vertically extending horizontal-spaced panels through which the liquid being cooled flows. Each of these panels typically comprises two dished sheet metal stampings welded together around their perimeters and defining spaced walls for the panel. The stampings are usually provided with debossments that divide the interior of the panel into vertically extending flow passages for the liquid passing through the panel. Reference may be had to U.S. Pat. No. 1,619,322-Dann for an example of such a panel-type radiator.

Panel radiators of this general design have not been as thermally efficient as might be desired. Our studies of this problem indicate that there are several factors contributing to this reduced efficiency. One is unequal distribution of the vertically-rising cooling air over the face of the panel, or, more specifically the reduced flow of such cooling air over the inner regions of the panel that are spaced from the vertical edges of the panels. Another is stratification of oil along the panel width, as reflected in the cooler oil being concentrated near the outer vertical edges.

SUMMARY

An object of our invention is to provide the panels with embossments that are so configured as to cause the flow of upwardly-moving cooling air to be distributed more evenly over the face of the panel as compared to corresponding panels without such embossments.

Another object is to provide embossments that promote the flow of oil within each panel from the median region to the vertical-edge regions where cooling is more effective.

Still another object is to provide embossments capable of functioning as above and also capable of imparting significant additional mechanical strength for improving the ability of the panels to resist distortion by fluid pressures and by the stresses of the welding operations used in fabrication of the panels.

In carrying out our invention in one form, we provide a vertically-extending panel for extracting heat from liquid flowing therethrough. The panel comprises two dished metal sheets welded together around their perimeters. The sheets have aligned vertically-extending debossments welded together at their inner ends along a vertically-extending zone, thus providing spaced, side-by-side vertically-extending flow channels on opposite sides of the vertically-extending zone. Liquid enters the panel through an inlet at its upper end, flows downwardly through the flow channels, and exits through an opening at the lower end of the panel. The portions of the sheets defining the walls of the flow channels are provided with vertically-spaced embossments arranged on each sheet in a generally herringbone pattern, with the individual embossments extending transversely of the vertically-extending zone via a path that slopes upwardly as the vertically-extending zone is approached.

BRIEF DESCRIPTION OF DRAWINGS

For a better understanding of the invention, reference may be had to the following description taken in connection with the accompanying drawings, wherein.

DETAILED DESCRIPTION OF PREFERRED EMBODIMENTS

Figure 1:
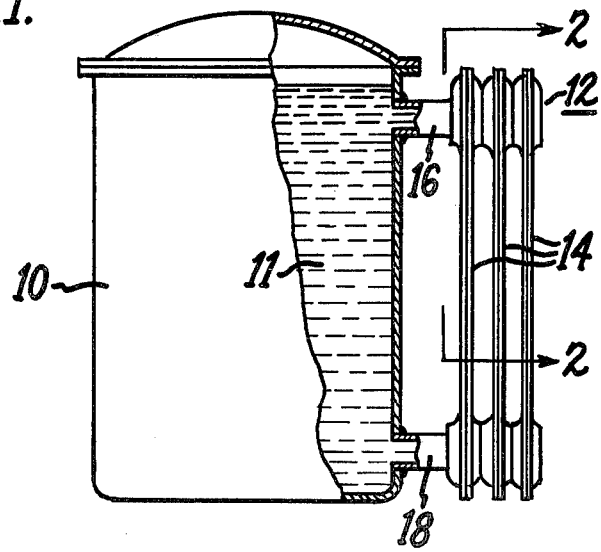
FIG. 1 is a side elevational view, partly in section, showing liquid-filled electrical apparatus having a panel-type radiator embodying one form of the present invention.

Referring first to FIG. 1, there is shown electrical apparatus, such as a distribution transformer or a voltage regulator, comprising a metal tank 10 filled with dielectric fluid 11 such as oil. Attached to the side of the tank is a panel type radiator 12 comprising a plurality of vertically-extending panels 14 disposed in face-to-face, horizontally spaced-apart relationship with vertical passages between the exterior faces of the panels. The radiator 12 includes a pair of vertically-spaced header pipes 16 and 18 at its upper and lower ends communicating with the interior of the tank 10 at its upper and lower ends, respectively. The normal liquid level of the oil 11 in the tank 10 is above the location of the upper header pipe 16.

When the electrical apparatus is in operation, the oil in the tank 10 becomes heated. The hottest oil rises to the top of the tank through natural convection, entering the radiator through the upper pipe 16. As the oil is cooled within the radiator 12, it flows downwardly through the panels 14, returning to the tank interior through the lower pipe 18 as relatively cool oil. The oil continues circulating over this path, moving upwardly within the tank 10 and downwardly within the radiator 12, as the electrical apparatus is operated. The radiator, of course, serves to extract heat from the oil as it flows downwardly therethrough, thus limiting the temperature of the oil within tank 10.

Figure 2:
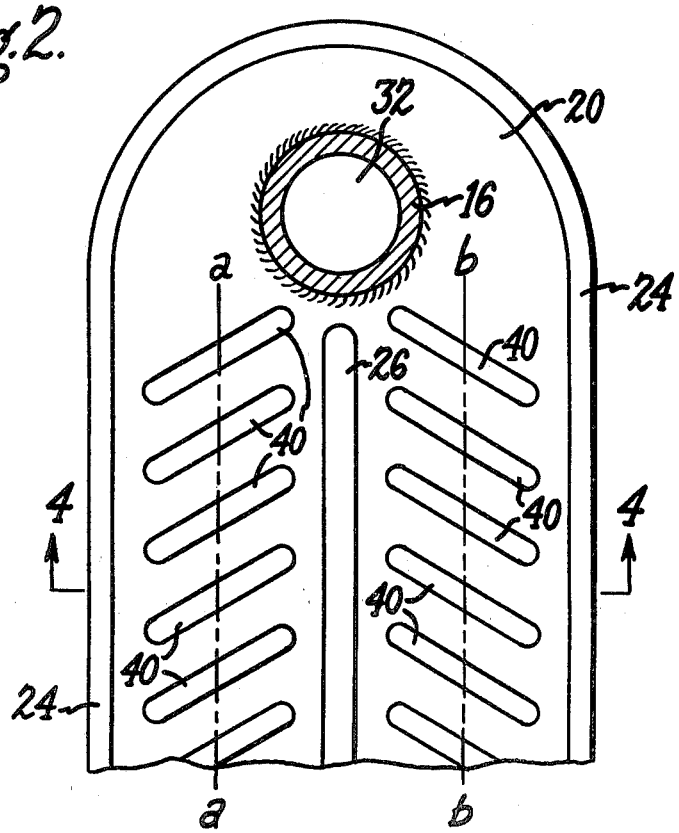
FIG. 2 is an enlarged sectional view along the line 2—2 of FIG. 1.
Figure 3:
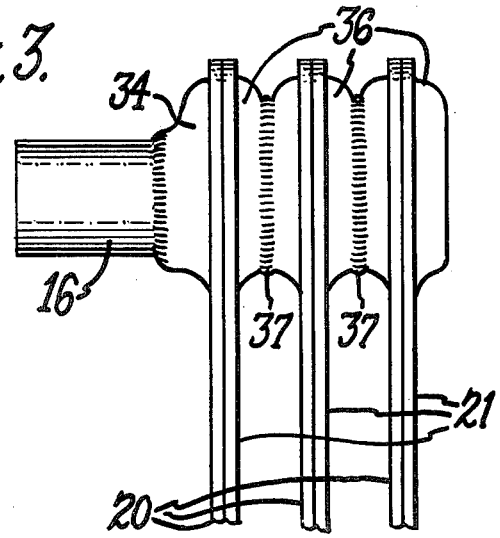
FIG. 3 is an enlarged view of a portion of FIG. 1.
Figure 4:
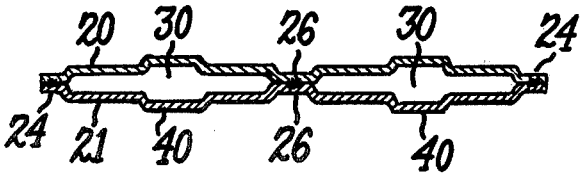
FIG. 4 is an enlarged sectional view along the line 4—4 of FIG. 2.

Referring to FIGS. 2, 3, and 4, each of the radiator panels 14 comprises two dished, metal sheets 20 and 21 respectively forming halves of the panel. These sheets 20 and 21 have substantially aligned perimeters 24 and are seam welded to each other along these aligned perimeters. Each of the sheets 20 and 21 has a vertically-extending medial debossment 26. These debossments 26 are aligned with respect to each other and are spot welded together at their abutting inner ends along a vertically-extending zone, as seen in FIG. 2. These aligned debossments 26 divide the panel into two spaced-apart, side-by-side vertically-extending flow channels 30 located between sheets 20 and 21 on opposite sides of the aligned debossments 26.

Each panel 14 has means defining an inlet opening 32 at its upper end through which liquid can enter the panel before flowing downwardly through the flow passages 30. Surrounding this inlet opening 32 is a flared header embossment integral with the dished metal sheet 20. The other sheet 21 has a substantially identical flared header embossment 36 aligned with that of sheet 20. Each of these header embossments except the one on the outer sheet 21 of the outermost panel has an opening therethrough. The header embossments 34 and 36 of adjacent panels are disposed in abutting relationship and are suitably welded together around the outside periphery of the annular region where they abut. The details of this welded joint are not a part of our present invention. The header pipe 16 is welded, preferably by butt-welding at its outer end, to the header embossment 34 of the innermost panel, thus joining this pipe 16 to the panel assembly. The header pipe 16 and the aligned passageway through the panels formed by the joined header embossments 34 and 36 may be thought of as an upper header for the radiator. It will be understood that liquid entering this upper header can flow in hydraulically-parallel paths through the three panels 14.

The lower header construction is substantially identical to the upper header construction and will therefore not be described in detail. Liquid after flowing through any of the three panels 14 in parallel will return to the interior of tank 10 through this lower header.

It will be understood that the lower header provides an exit opening at the lower end of each panel through which liquid can exit from the panel after flowing downwardly therethrough.

Panel type radiators of the design described up to this point have not been as thermally-efficient as might be desired, having an efficiency about 25 percent below that of tube-type radiators. Factors that appear to contribute to this lower efficiency are the unequal distribution of cooling air on the exterior faces of the panels and the stratification of oil along the panel width. On the air side, the outer portions of the panels are swept by edge drafts without the inner areas receiving this benefit. On the oil side, the cooler oil is located toward the outer edges of the panels.

For improving convection on both the air and oil sides of the panel, we provide each of the sheets 20 and 21 with vertically-spaced embossments 40 arranged on each sheet in a generally herringbone pattern. As shown in FIG. 2, the individual embossments 40 extend transversely of the vertically-extending medial zone at 26 via a path that slopes upwardly as the vertically-extending zone is approached. These embossments 40 are located on the portions of each sheet that form the walls of passages 30 and project toward the exterior of the panel.

On the air side of the panel, the projections seem to improve heat transfer performance by directing more of the cool air passing over the face of the panel toward the center of the panel where there is otherwise less air flow than at the edges. On the oil side, the increased duct width along the embossments 40 provides a path of reduced flow resistance directed toward the outer edge of the panel, and this appears to cause hot oil to flow toward the more effectively cooled edge region and to create greater mixing action within the panel.

The projecting embossments 40 also contribute to improved cooling by providing additional contact surface area on both the air and oil sides of the panel.

Each of the dished sheets 20 and 21 is a single integral part formed by being stamped between suitably-shaped dies. The thinner these metal stampings are, the more effective the panel is in transferring heat from the liquid inside the panel to the exterior of the panel. But the thinner these stampings are, the more susceptible they are to distortion by fluid pressures developed within the panels and by the stresses of the above-referred-to welding operations used for fabricating the panels.

The embossments 40 are well suited to imparting the needed resistance to distortion. In this regard, it should be noted that when the panels are pressurized, the maximum panel deflection will tend to occur along the lines a—a and b—b of FIG. 2. The inclusion of the embossments 40 increases the moment of inertia along these lines, resulting in significant added stiffness of the panel.

Figure 5:
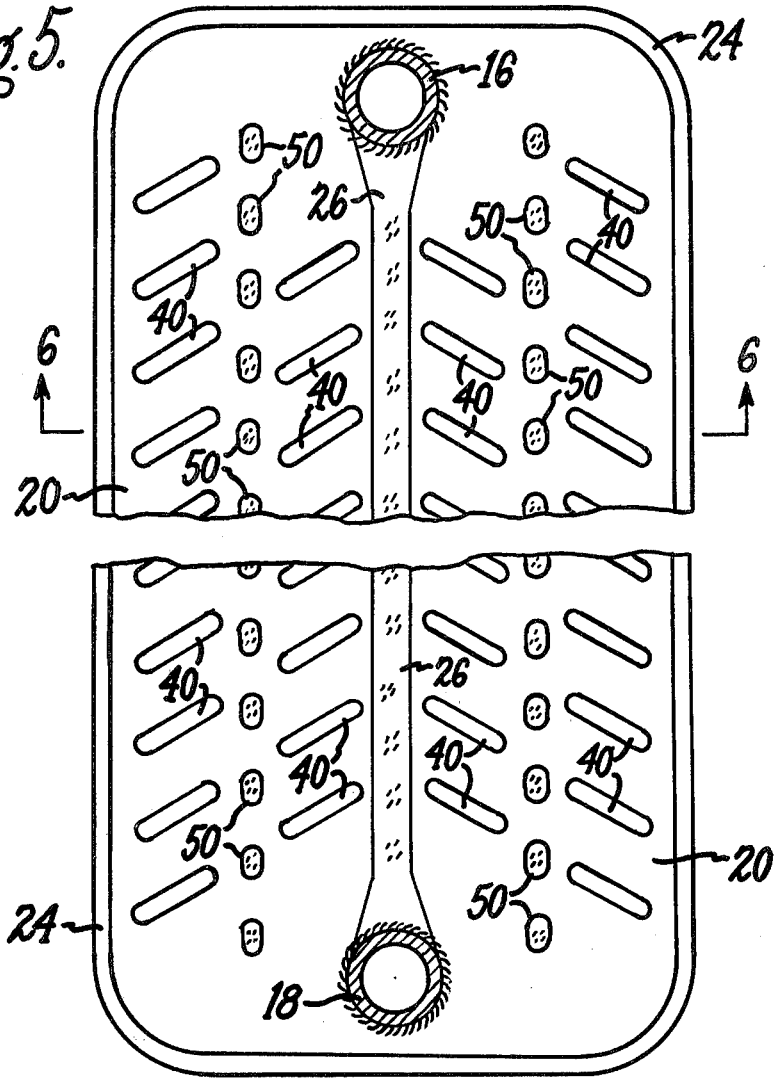
FIG. 5 is a view similar to that of FIG. 2 except showing a modified form of panel-type radiator.
Figure 6:
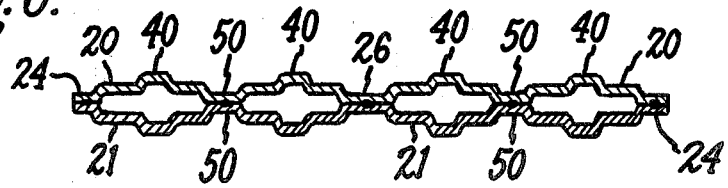
FIG. 6 is a sectional view along the line 6—6 of FIG. 5.

In certain applications, it is necessary that the panels have a greater width than is the case with the radiators of FIGS. 2–4. A panel design suitable for these applications is shown in FIGS. 5 and 6. Typically, this radiator uses panels about 15 inches in width as compared to the 8 or 9 inch width of the radiator of FIGS. 2–4. This panel design is quite similar to the design of FIGS. 2–4 except in one respect. To enable the wider panel of FIGS. 5 and 6 to withstand internal fluid pressures without distorting, a plurality of vertically-spaced debossments 50 are provided along two vertical lines, each approximately midway between the medial debossment 26 and one of the vertical edges of the radiator. The aligned debossments 50 on the two sheets engage at their inner ends and are there spot welded together. These spaced debossments impart added mechanical strength without greatly reducing liquid mixing between the central region of the panel and the region near its vertical edges.

Figure 7:
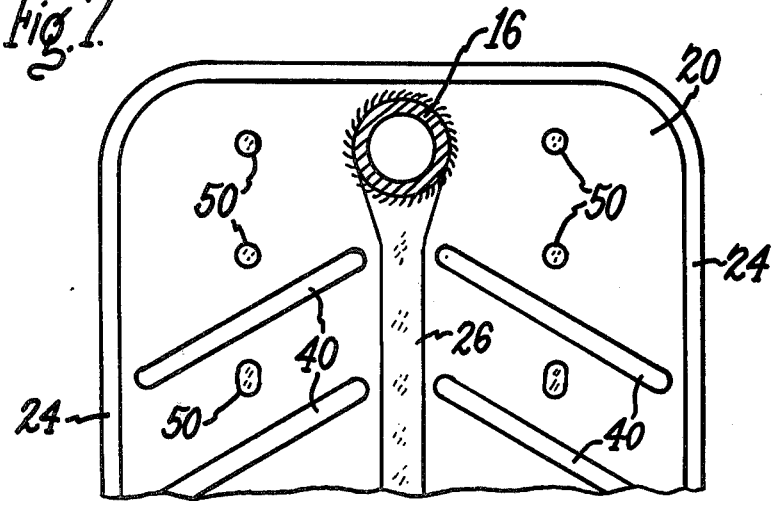
FIG. 7 is a view similar to that of FIG. 2 except showing another modified form of panel-type radiator.

Another embodiment of the wider panel-type radiator is shown in FIG. 7. In this embodiment the embossments 40 at each side of the medial debossment 26 extend from a location near the medial debossment to a location near the outer vertical edge of the panel. This is in contrast to the design of FIG. 5, where there are two separate embossments 40 along each of the bones in the herringbone pattern. An advantage of the longer embossment of FIG. 7 is that less force is required to form it out of the sheet metal starting blank than is needed for two separate embossments of comparable total length.

In the designs of both FIGS. 5 and 7, it is to be noted that the reinforcing debossments 50 are in the form of localized dimples rather than as a continuous vertically-extending trough. This has the advantage of allowing oil to flow more freely between the central region of the panel and the edge regions than would be the case if a continuous vertically-extending trough was present in this location. This freer flow promotes mixing between hotter liquid in the central region and the cooler liquid near the edges of the panel, thus counteracting the tendency for uneven cooling to occur as a result of the extra cooling that tends to occur along the vertical edges of the panel.

While we have shown and described particular embodiments of our invention, it will be obvious to those skilled in the art that various changes and modifications may be made without departing from our invention in its broader aspects; and we, therefore, intend herein to cover all such changes and modifications as fall within the true spirit and scope of our invention.

What we claim as new and desire to secure by Letters Patent of the United States is:

1. In a panel radiator comprising a generally vertically-extending panel for extracting heat from liquid flowing therethrough, said panel comprising:

(a) two dished metal sheets welded together around their perimeters, said perimeters defining the outer edge of the panel and the sheets defining spaced walls of the panel, (b) said sheets having generally vertically-extending debossments generally aligned with respect to each other and welded together at their inner ends along a generally vertically-extending zone, thus providing spaced, side-by-side, generally vertically-extending flow channels between said sheets on opposite sides of said vertically-extending zone, (c) means defining an inlet opening at the upper end of said panel through which liquid can enter said panel before flowing downwardly through said flow channels, and means defining an exit opening at the lower end of said panel through which liquid can exit from the panel after flowing through said flow channels, and (d) the portions of said sheets defining the walls of said channels being provided with vertically-spaced embossments projecting toward the exterior of said panel and arranged on each sheet in a generally herringbone pattern, with the individual embossments extending transversely of said vertically-extending zone via a path that slopes upwardly as said vertically-extending zone is approached.

2. The panel radiator of claim 1 in which said radiator comprises: (a) a plurality of spaced-apart, face-to-face, generally vertically extending panels, each constructed as defined in claim 1, and (b) headers at the upper and lower ends of said panels for connecting the panels hydraulically in parallel.

3. The panel radiator of claim 1 in which said vertically-extending debossments are disposed generally medially of their respective sheets and extend between the region of said inlet opening and the region of said outlet opening.

4. The panel radiator of claim 1 in which each of said embossments extends from a region near the outer edge of said panel to a region near said vertically-extending zone.

5. The panel radiator of claim 1 in which said panel has two laterally-spaced, vertically-extending edge portions and further comprises:

(a) a first plurality of additional debossments on said two sheets located between said vertically-extending zone and one of said vertically-extending edge portions, (b) a second plurality of additional debossments on said two sheets located between said vertically-extending zone and the other of said vertically-extending edge portions; and in which pairs of said additional debossments on the two sheets are generally aligned with each other and are welded together at their inner ends.

6. The panel radiator of claim 5 in which said additional debossments of said first plurality are vertically spaced with respect to each other, thereby allowing liquid to flow from the central region of said panel toward said one vertically-extending edge via the spaces between said additional debossments.

7. The panel radiator of claim 5 in which (a) said first plurality of additional debossments on one sheet are disposed along a generally vertically-extending line located between said vertically-extending zone and one of said vertically-extending edge portions, and (b) said second plurality of additional debossments on said one sheet are disposed along a generally vertically-extending line located between said vertically-extending zone and the other of said vertically-extending edge portions.

* * * * *